United States Patent [19]

Delgrange

[11] Patent Number: 4,546,289

[45] Date of Patent: Oct. 8, 1985

[54] PROCESS FOR ESTABLISHING CONTROL SIGNALS FOR AN ALTERNATING PLASMA PANEL

[75] Inventor: Louis Delgrange, Paris, France

[73] Assignee: Thomson-CSF, Paris, France

[21] Appl. No.: 604,817

[22] Filed: Apr. 27, 1984

Related U.S. Application Data

[63] Continuation of Ser. No. 302,568, Sep. 15, 1981, abandoned.

[30] Foreign Application Priority Data

Sep. 9, 1980 [FR] France ..... 80 19415

[51] Int. Cl.[4] ..... H05B 37/00

[52] U.S. Cl. ..... 315/169.4; 340/805; 365/116

[58] Field of Search ..... 365/116; 315/169.3, 315/169.4; 340/758, 805

[56] References Cited

U.S. PATENT DOCUMENTS

| | | | |
|---|---|---|---|
| 3,909,804 | 9/1975 | Kaji et al. | 340/758 |
| 4,017,762 | 12/1978 | Criscimagna | 315/169.4 |
| 4,140,944 | 2/1979 | Miller | 315/169.4 |

*Primary Examiner*—Harold Dixon

[57] ABSTRACT

This invention concerns a process for establishing control signals for an alternating plasma panel which consists in applying simultaneously:

a "selection" voltage to one of the electrodes in one of the networks;

a "non-selection" voltage to the other electrodes in the same network;

a "setting" or "clearing" voltage to each electrode in the other network.

7 Claims, 29 Drawing Figures

"PRIOR ART"

"PRIOR ART"

PROCESS FOR ESTABLISHING CONTROL SIGNALS FOR AN ALTERNATING PLASMA PANEL

This application is a continuation of application Ser. No. 302,568, filed Sept. 15, 1981 now abandoned.

SUMMARY OF THE INVENTION

This invention concerns a process for establishing the control signals for an alternating plasma panel. It also relates to alternating plasma panels controlled by signals established by means of such a process.

BACKGROUND ART

Alternating plasma panels are known in the prior art, and are published in French patent application No. 78.04893, delivered under No. 2 417 848, in the name of Thomson-CSF, and in an article published in *Revue Technique Thomson CSF,* June 1978, vol. 10, No. 2, pp. 249–275.

These panels comprise a large number of cells arranged in matrix formation. Each cell consists of the gaseous space situated at the intersection between two electrodes belonging to two orthogonal electrode networks, and is subject to control signals consisting of the difference in voltages applied to the two electrodes between which it is situated.

Control signals comprise setting signals turning cells on, clearing signals turning them off, and maintenance signals, which keep them in their initial state, whether off or on.

Unlike maintenance signals, which are applied to all electrodes in the panel in order to display information, setting and clearing signals are selective signals, which turn only selected cells on and off.

Consequently, a given cell $C_{xy}$ is set only if both its electrodes x and y receive appropriate voltages $V_x$ and $V_y$, which produce the setting signal at only the terminals of that cell.

The same conditions apply to the clearing of this cell.

In the prior art, the voltages $V_x$ and $V_y$ to set cell $C_{xy}$ are different from the voltages $V'_x$ and $V'_y$ needed to reset it.

Consequently, it is not possible to obtain simultaneous assorted setting and clearing of cells sharing an electrode, namely cells located on the same line or column of the panel.

There is therefore a problem with alternating plasma panels when displaying successive images, such as television pictures.

It is impossible to set the images quickly, i.e. with a setting time for each line of approximately 20 μs, and to make the images succeed one another quickly, indeed more or less uninterruptedly.

It should be remembered that alternating plasma panels store every image set on them. Since selective cell setting and clearing cannot be obtained simultaneously for a given line, the panel has to be cleared before a new image is entered.

It is possible:

either to clear the whole panel at once, then set a new image, line by line, the disadvantage here being that the different lines of the panel do not have the same display time, so that brightness varies from one line to another; this image defect increases with the speed of changes of images;

or to clear one or several lines of the panel, then set them line by line, the disadvantage here being that setting time for each image is greatly increased, in fact even doubled, where only one line is cleared before setting it again: approximately $2\times20$ μs is needed to set one line.

This invention offers a way of overcoming the problem of image display by means of alternating plasma panels, by removing the drawbacks of brightness variation and increase of setting time, without altering the memory capacity of such panels.

BRIEF DESCRIPTION OF THE INVENTION

This invention concerns a process for establishing control signals for an alternating plasma panel, in which:

- a "selection" voltage is applied to one of the electrodes in one of the panel networks, and a "non-selection" voltage to the other electrodes in the same network;
- a voltage chosen from at least two "setting" and "clearing" voltages is applied simultaneously to each electrode in the other network;

the form, amplitude and duration of these impulses being such that cells receiving the selection voltage at one electrode and the setting or clearing voltage at the other electrode are either set or cleared, while cells receiving the non-selection voltage at one electrode are all maintained in their initial state, regardless of what voltage is received at the other electrode.

This invention makes it possible to obtain simultaneous settings and clearings in a given line or column. It is thus no longer necessary to clear the panel in order to change the image. An image is displayed on the panel, line by line (or column by column), then a new image is displayed, by making the necessary selective settings and clearings in each line (or column). The brightness of the image no longer fluctuates and setting time for each line is only 20 μs.

Other functions, features and results of the invention will be made clear in the following description of one of the possible embodiments, with reference to the accompanying drawings.

The same references are used for the same components in these figures; however, for greater clarity, dimensions and proportions of the various components are not respected.

DETAILED DESCRIPTION

Figure 1:
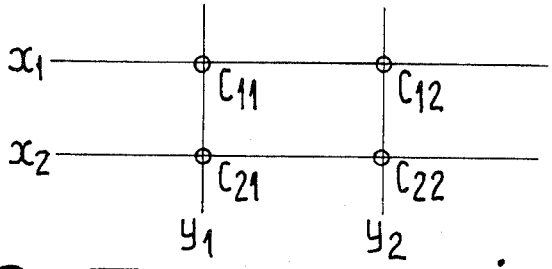
FIGS. 1 and 4 show several cells of a plasma panel, in diagrammatical form.

FIG. 1 shows four plasma panel cells $C_{11}$, $C_{12}$, $C_{21}$ and $C_{22}$, situated at the intersection of two horizontal electrodes $x_1$ and $x_2$ and two vertical electrodes $y_1$ and $y_2$.

Figure 2:
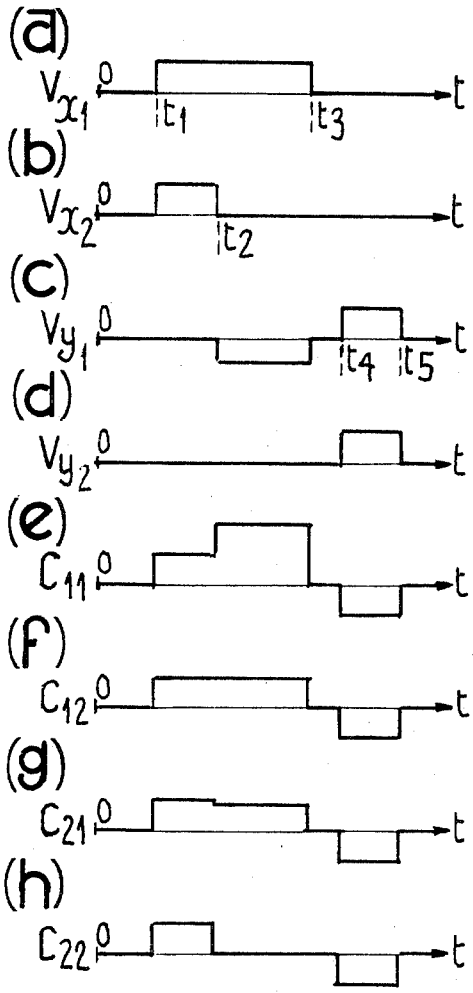
FIGS. 2*a* to 2*h* and 3*a* to 3*h,* show the voltages which, in the prior art, are applied to the electrodes of the cells shown in FIG. 1, and the control signals received by these cells, in order to set and clear one of them.

FIGS. 2*a, b, c* and *d* represent the voltages $V_{x1}$, $V_{x2}$, $V_{y2}$ and $V_{y2}$, applied in the prior art to electrodes $x_1$, $x_2$, $y_1$ and $y_2$, in order for only cell $C_{11}$ to be set;

voltage $V_{x1}$ has an amplitude of $V_1$ and lasts $t_3-t_1$;

voltage $V_{x2}$ has the same amplitude $V_1$ and lasts $t_2-t_1$, which is shorter than $t_3-t_1$;

voltage $V_{y1}$ comprises a negative portion with an amplitude of $V_2$ which is lower than $V_1$ and lasts $t_3-t_2$, followed by a positive portion with an amplitude of $V_1$ and which lasts $t_5-t_4$;

finally, voltage $V_{y2}$ has an amplitude of $V_1$ and lasts $t_5-t_4$.

FIGS. 2*e, f, g* and *h* show the control signals applied to cells $C_{11}$, $C_{12}$, $C_{21}$ and $C_{22}$, and which result from the differences in voltages received at the two electrodes between which each cell is situated. The voltage $V_1+V_2$ that thereupon appears from $t_2$ to $t_3$ at the terminals of cell $C_{11}$ is sufficient to cause setting.

Voltage amplitude received by other cells does not exceed $V_1$, which is inadequate to set them.

Consequently, only cell $C_{11}$ is set.

It will be noted that, for the four signals applied to the cells shown in FIGS. 2*e* to 2*h*, there is at $t_1$ a rising front with an amplitude of $V_1$, and at $t_4$ a descending front with an amplitude of $-V_1$, corresponding to the characteristics of maintenance signals, and therefore permitting display of information already entered on the panel.

Figure 3:
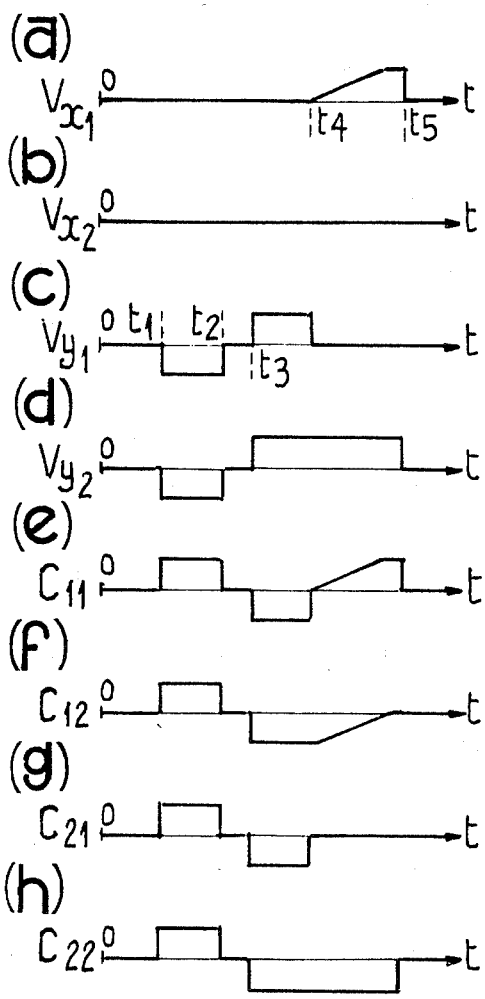

FIG. 3*a, b, c* and *d* show the voltages $V_{x1}$, $V_{x2}$, $V_{y1}$ and $V_{y2}$, applied in the previous art to electrodes $x_1$, $x_2$, $y_1$ and $y_2$, in order for only cell $C_{11}$ to be cleared. These voltages will be described with reference to times $t_1$ to $t_5$, succeeding one another on the time axis 0t, in the order $t_1$ to $t_5$:

voltage $V_{x1}$ varies from $t_4$ approximately lineally in relation to time, from 0 to $V_1$, then stabilizes at $V_1$, and redescends to 0 at $t_5$; the use of such a voltage to clear a cell has been described in patent application No. 78.04893 already referred to;

voltage $V_{x2}$ is constantly 0;

voltage $V_{y1}$ comprises a negative portion with an amplitude of $V_1$ from $t_1$ to $t_2$, followed by a positive portion with an amplitude of $V_1$ from $t_3$ to $t_4$;

voltage $V_{y2}$ differs from $V_{y1}$ only in that its positive portion is longer, lasting from $t_3$ to $t_5$.

FIGS. 3*e* to 3*h* show the control signals applied to cells $C_{11}$, $C_{12}$, $C_{21}$ and $C_{22}$. Only the signal applied to cell $C_{11}$ causes clearing because of the portion of linear growth of the voltage from 0 to $V_1$ between $t_4$ and $t_5$.

It will be noted that in this case too the four signals received by the cells result in maintenance of their state, because of the rising front to $V_1$ at $t_1$ and the descending front towards $-V_1$ at $t_3$. Only cell $C_{11}$ is cleared while other cells are maintained in their initial state.

Voltages $V_{x1}$ and $V_{y1}$ to set cell $C_{11}$ differ from the voltages $V_{x1}$ and $V_{y1}$ to clear it. This may be seen by comparing FIGS. 2*a* and 3*a*, and 2*c* and 3*c*.

In conclusion, and as already stated, the prior art does not allow simultaneous selective settings and clearings of cells sharing an electrode; e.g. it is not possible to set $C_{11}$ and simultaneously clear $C_{12}$ or $C_{21}$. Reference has already been made to the problem this raises for the display of images succeeding one another on alternating plasma panels.

Figure 4:
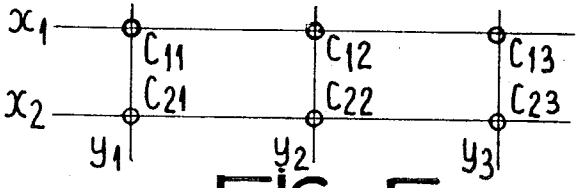

FIG. 4 shows six cells $C_{11}$, $C_{12}$, $C_{13}$, $C_{21}$, $C_{22}$ and $C_{23}$, situated at the intersections of two horizontal electrodes $x_1$ and $x_2$, and three vertical electrodes $y_1$, $y_2$ and $y_3$.

FIGS. 5*a* to 5*e* illustrate the procedure for establishing control signals in this invention. These figures show the voltages $V_{x1}$, $V_{x2}$, $V_{y1}$, $V_{y2}$ and $V_{y3}$, which are applied to the electrodes $x_1$, $x_2$, $y_1$, $y_2$ and $y_3$, in order, for instance, to cause setting of $C_{11}$, clearing of $C_{12}$, and maintenance of the initial state of $C_{13}$, as well as maintenance of the other cells, $C_{21}$, $C_{22}$ and $C_{23}$ in their initial state. FIGS. 5*f* to 5*k* show the resulting voltages obtained at the terminals of cells $C_{11}$, $C_{12}$, $C_{13}$, $C_{21}$, $C_{22}$ and $C_{23}$.

In FIGS. 5*a* to 5*k*, the selective portion of voltages, in other words the portion that is not identical for all electrodes and all cells, and which in the example illustrated extends from $t_3$ to $t_4$, is represented by a broken line. Times $t_1$ to $t_6$, following one another in this order, are shown on the time axis 0t.

In the same figures, the non-selective portion of voltages, which is identical for all electrodes and cells, and which is designed to apply to all cells a maintenance signal consisting of a positive portion with an amplitude of $V_1$ and a negative portion with an amplitude of $V_1$, is represented by a full line.

In the example illustrated in FIGS. 5*a* to 5*e*, the non-selective portion is obtained by including a positive portion with an amplitude of $V_1$, from $t_1$ to $t_2$, for voltages $V_{y1}$, $V_{y2}$ and $V_{y3}$, and a positive portion with an amplitude of $V_1$, from $t_5$ to $t_6$, for voltages $V_{x1}$ and $V_{x2}$.

It would, of course, be possible to proceed differently, for instance by including a negative portion with an amplitude of $V_1$, from $t_5$ to $t_6$, for voltages $V_{y1}$, $V_{y2}$ and $V_{y3}$, and applying a zero voltage, from $t_5$ to $t_6$, for voltages $V_{x1}$ and $V_{x2}$.

Figure 5:
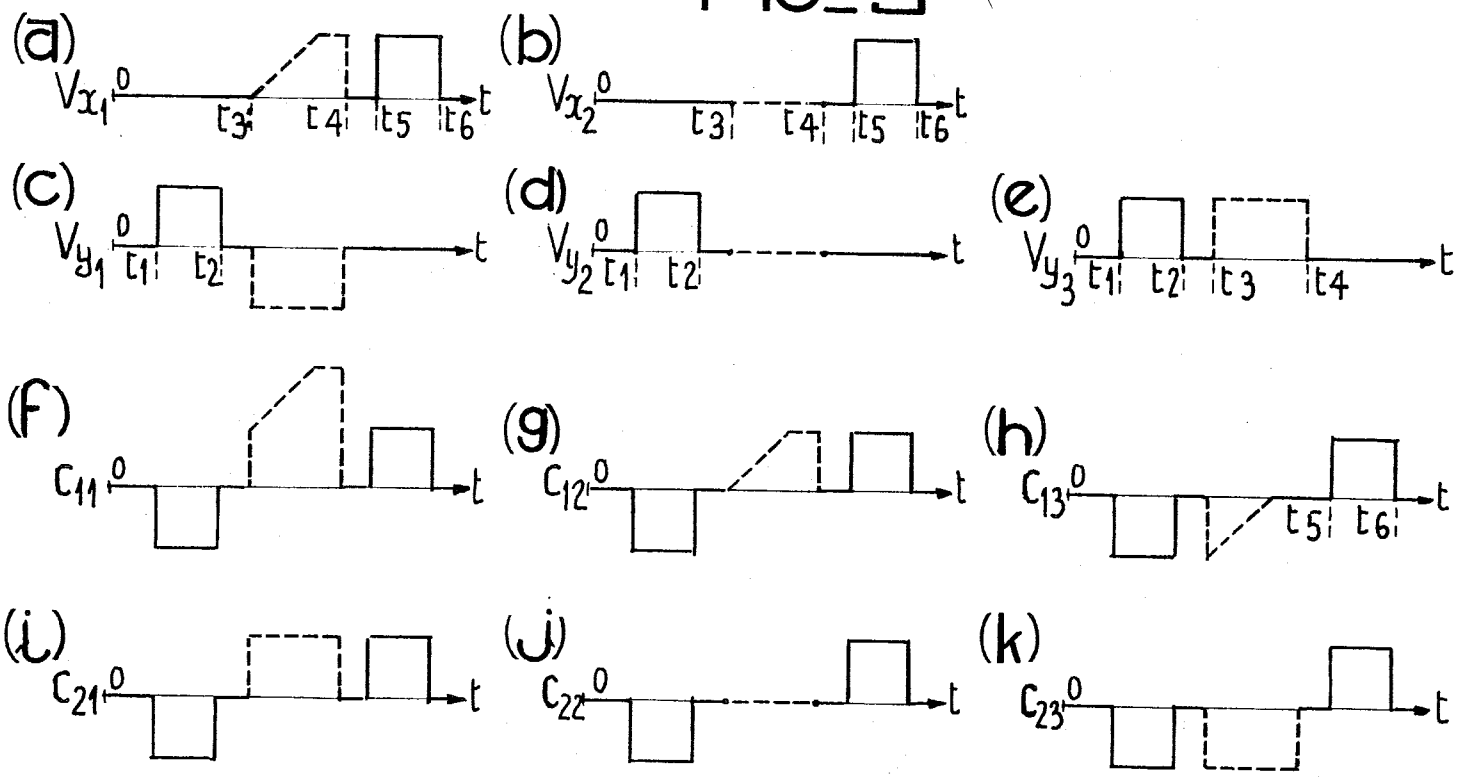
FIGS. 5*a* to 5*k,* show the voltages which, in this novel process, are applied to the electrodes of the cells shown in FIG. 4, and the control signals received by these cells.

The instant process involves:

applying to electrode $x_1$, which corresponds to the line on which simultaneous and selective setting, clearing and maintenance of a cell in its initial state are required, a "selection" voltage; in FIG. 5*a*, this voltage begins to rise at $t_3$, approximately lineally in relation to time, from 0 to $V_1$, then stabilizes at $V_1$, and redescends to 0 at $t_4$;

applying to the other electrode $x_2$ a "non-selection" voltage, which in FIG. 5*b* is nul from $t_3$ to $t_4$;

applying, also from $t_3$ to $t_4$:

to electrode $y_1$, a "setting" voltage, in order to set cell $C_{11}$; in FIG. 5*c*, this voltage is negative, with an amplitude of $V_1$;

to electrode $y_2$, a "clearing" voltage, in order to clear cell $C_{12}$; in FIG. 5*d*, this voltage is zero;

to electrode $y_3$, a "maintenance" voltage, to keep cell $C_{13}$ in its initial state; in FIG. 5*e*, this voltage is positive, with an amplitude of $V_1$.

The form, amplitude and duration of the various selection, non-selection, setting, clearing or maintenance voltages are calculated to ensure that cells receiving the selection voltage at one electrode and the setting, clearing or maintenance voltage at the other electrode are set, cleared, or maintained in their initial state, whereas cells receiving the non-selection voltage at one electrode are maintained in their initial state, regardless of the voltage received at the other electrode.

This is what happens with the voltage represented by broken lines in FIGS. 5*a* to 5*e*, which are provided merely for illustration. Examination of FIGS. 5*f* to 5*k* shows that:

cell $C_{11}$ is set, since between $t_3$ and $t_4$ it receives a high voltage, reaching $2V_1$;

cell $C_{12}$ is cleared, since between $t_3$ and $t_4$ it receives a voltage which increases lineally in relation to time, from 0 to $V_1$;

other cells, $C_{13}$, $C_{21}$, $C_{22}$ and $C_{23}$ are maintained in their initial state since they receive voltages shown in FIGS. 5*h* to 5*k*, which are successively positive and negative with an amplitude of $V_1$ but which never attain a high enough amplitude to set them, and which also do not comprise any portion with linear voltage increase, to clear them.

With this new procedure:

the electrodes of one network receive a "selection" voltage or a "non-selection" voltage;

the electrodes of the other network receive a "setting", "clearing", "maintenance" or any other voltage to place the cell in a given state.

Setting, clearing and maintenance of cells is achieved simultaneously and selectively, for a given line or column.

In the prior art, on the other hand, the various cycles, such as setting and clearing, are performed separately, which electrodes in each network receiving only two types of voltage, either selection or non-selection, peculiar to each given cycle.

As already described, this new procedure solves the problem of displaying succeeding images by means of plasma panels.

If no area of the image remains unchanged from one image to the next, it is unnecessary to obtain setting, clearing and maintenance of the cells in their initial state, simultaneously and selectively. Only selective settings and clearings are needed. The electrodes in one network consequently receive a voltage selected solely from setting or clearing voltages.

If certain areas of the image remain unchanged, however, it is an advantage to be able to achieve simultaneous and selective settings, clearings and maintenance of cells in their initial state.

Control circuits for a plasma panel employing this newprocess are based directly on those described in patent application No. 78.04893, already referred to.

What is claimed is:

1. A process for establishing control signals for an alternating plasma panel, in which these signals are applied to two electrodes belonging to two orthogonal networks, and each cell of the panel is formed by the gaseous space located at the intersection between two electrodes in different networks, said procedure being characterized by the fact that:

a "selection" voltage (Vx1) is applied to one of the electrodes in one of the networks, and a "non-selection" voltage (Vx2) is applied to the other electrodes in the same network;

simultaneously, a "setting" voltage and a "clearing" voltage (Vy1 and Vy2) are applied respectively to the two electrodes in the other network; the form, amplitude and duration of such voltages being such that cells receiving the selection voltage at one electrode and the setting voltage or clearing voltage at the other electrode are either set or cleared accordingly, while cells receiving the non-selection voltage at one electrode are all maintained in their initial state, regardless of the voltage applied to the other electrode; and "maintenance" voltage, and cells receiving the maintenance voltage at one electrode and the selection or non-selection voltage at the other electrode being maintained in their initial state.

2. A process as defined in claim 1, in which:

the selection voltage rises lineally in relation to time, from 0 to $V_1$, then stabilizes at $V_1$, before returning to 0;

the non-selection voltage is 0;

the setting voltage is negative, with an amplitude of $V_1$;

the clearing voltage is 0;

3. An alternating plasma panel, in which the control signals are established by means of the procedure defined in claim 1.

4. A process as defined in claim 1 in which:

the selection voltage rises lineally in relation to time, from 0 to V1, then stabilizes at V1, before returning to 0;

the non-selection voltage is 0;

the setting voltage is negative, with an amplitude of V1;

the clearing voltage is 0.

5. An alternating plasma panel, in which the control signal are established by means of the following procedure:

the selection voltage rises lineally in relation to time, from 0 to $V_1$, then stabilizes at $V_1$, before returning to 0;

the non-selection voltage is 0;

the setting voltage is negative, with an amplitude of $V_1$;

the clearing voltage is 0;

the maintenance voltage is positive, with an amplitude of $V_1$.

6. A process for controlling a plasma panel, said panel having, first, second, third, and fourth electrodes, cells located at the intersections of the first electrode with the third and fourth electrodes, and at the intersection of the second electrode with the third and fourth electrodes, and having a gas display space at each of said electrode intersections;

each of said cells:

(i) being set by a predetermined set voltage being applied across said cells' gas space by said cells' intersecting electrode, (ii) being cleared by a predetermined cleared voltage being applied across said cells' gas space by said cells' intersecting electrode, (iii) being maintained by a voltage which is neither a set nor a cleared voltage being applied across said cells' gas space by said cells' intersecting electrodes;

said process comprising the steps of (a) applying a first (selection) voltage to the first electrode;

(b) simultaneously applying a second (non-selection) voltage to the second electrode;

(c) simultaneously applying a third (setting) voltage to said third electrode; and (d) simultaneously apply a fourth (clearing) voltage to said fourth electrode; and (e) choosing said first (selection) voltage and choosing said third (setting) voltage such that the combination of said voltages across a cell is said predetermined set voltage, and when said two voltages are simultaneously applied to a cell the cell is set;

(f) choosing said fourth (clearing) voltage such that the combination of said fourth voltage and said first (selection) voltage across a cell is said cleared voltage and when said voltages are applied across a cell, it clears said cell;

(g) choosing said second (non selection) voltage such that the combination of said second voltage with said third (setting) and the combination of said second voltage with said fourth (clearing) voltage across any of said cells neither sets nor clears said cells;

whereby the two cells having a common first electrode may be simultaneously set and cleared.

7. A process according to claim 6, wherein said panel has a fifth electrode intersecting said first and second electrodes and having a gas display space at each of said intersections; and comprising the further steps of:

simultaneously applying with said first (selection) and said second (non selection) voltages a fifth (maintaining) voltage to said fifth electrode;

choosing said fifth (maintaining) voltage such that the combination of said fifth voltage and said first (selection) voltage across a cell is one of said voltages which maintains said cell; and further choosing said fifth (maintaining) voltage such that the combination of said fifth voltage and said second (non selection) voltage across a cell is one of said voltages which maintains said cell;

thereby three cells having a common electrode may be simultaneously set, cleared, and maintained, respectively.

* * * * *